US006056623A

United States Patent [19]

Arriola

[11] Patent Number: 6,056,623

[45] Date of Patent: May 2, 2000

[54] PLAYSET RESEMBLING A FANCIFUL ANTHILL

[75] Inventor: Martin F. Arriola, Torrance, Calif.

[73] Assignee: Mettel, Inc., El Segundo

[21] Appl. No.: 09/244,812

[22] Filed: Feb. 5, 1999

[51] Int. Cl.[7] ..... A63H 33/22; E04H 15/00; F21V 1/16; G09F 13/00

[52] U.S. Cl. ..... 446/476; 446/168; 135/124; 135/901; 362/357; D21/836; 40/540

[58] Field of Search ..... 446/82, 85, 168, 446/476, 477, 478, 485; 135/901, 124, 136, 137, 90, 91, 99, 104; 362/357, 806–811; D21/834, 836, 837, 507, 508, 510; 40/442, 540, 538; 472/61; 43/1

[56] References Cited

U.S. PATENT DOCUMENTS

| | | |
|---|---|---|
| 1,459,715 | 6/1923 | Bliss . |
| 2,178,634 | 11/1939 | Howenstine . |
| 2,680,317 | 6/1954 | Lewis . |
| 3,244,870 | 4/1966 | Gallant et al. . |
| 3,340,133 | 9/1967 | Krekovich . |
| 3,690,334 | 9/1972 | Miller . |
| 3,899,168 | 8/1975 | Beherse . |
| 4,067,137 | 1/1978 | Korhase . |
| 4,161,081 | 7/1979 | Katzman et al. . |
| 4,319,424 | 3/1982 | Goldfarb et al. . |
| 4,462,066 | 7/1984 | Gibson et al. . |
| 4,556,391 | 12/1985 | Tardivel et al. . |
| 4,639,234 | 1/1987 | Atwood . |
| 4,795,394 | 1/1989 | Thompson . |
| 4,938,730 | 7/1990 | Yamane et al. . |
| 4,941,859 | 7/1990 | Zaruba . |
| 5,085,609 | 2/1992 | Haberle . |
| 5,129,655 | 7/1992 | Gillespie et al. . |
| 5,261,849 | 11/1993 | French . |
| 5,344,143 | 9/1994 | Yule . |
| 5,400,541 | 3/1995 | Ennamorato et al. ..... 43/1 |
| 5,630,439 | 5/1997 | Hutto ..... 135/90 |

*Primary Examiner*—Robert A. Hafer
*Assistant Examiner*—Laura Fossum
*Attorney, Agent, or Firm*—Roy A. Ekstrand

[57] ABSTRACT

A toy playset is fabricated of a tent like fabric cover to represent a fanciful depiction of an anthill. The tent-like cover is formed about a frontal opening which facilitates viewing of the enclosure interior. A base secured to the tent-like enclosure further supports a vertically extending trunk which in turn supports the upper portion of the tent-like structure together with a platform. The platform further supports a table in a manner facilitating raising or lowering the table. A plurality of projectile launchers are supported by the table. A spring loaded catapult launcher is positioned upon the outer portion of the base and a ball guiding member extends downwardly from an aperture formed in the table to provide a ball rolling path which deposits a ball into the catapult causing a launch of the ball. Additional projectile launchers are provided on the supporting base. The fabric utilized on the tent-like structure is preferably translucent or otherwise light transmissive in character. A plurality of darkened opaque areas resembling silhouettes are formed on the inner surface of the tent-like member. A battery powered light within the tent interior illuminates the silhouettes.

6 Claims, 3 Drawing Sheets

PLAYSET RESEMBLING A FANCIFUL ANTHILL

FIELD OF THE INVENTION

This invention relates generally to toy playsets and particularly to those having a cooperating plurality of toy figures useable therewith.

BACKGROUND OF THE INVENTION

Toy playsets are well known in the art and have for many years enjoyed great popularity. Not surprisingly, such toy sets have been provided in a variety of styles or themes and a corresponding variety of physical appearances. Most playsets utilize a plurality of cooperating elements such as toy figures or dolls or alternatively toy vehicles. The basic structure element of most playsets is found in a structure which forms an enclosure or semi-enclosure within which various toy figures or toy vehicles are moveable and receivable.

As the popularity of toy playsets have continued through the years, practitioners in the art have provided different types of toy playsets having various features. Features have included toy weapons, elements of chance and game play, music, speech or lighting effects. For example, U.S. Pat. No. 4,161,081 issued to Katzman et al. sets forth a AMUSEMENT SET having a carrying case formed of half portions which are pivotally secured along a common edge of each. The case halves are thus pivotable between a closed configuration which secures items therein and an open configuration providing a semi-enclosure which is accessible to the user through open sides of each half portion. The center hinge incorporates a vertically moveable elevator.

U.S. Pat. No. 4,319,424 issued to Goldfarb et al. set forth a PLAY HOUSE APPARATUS having a base forming a multi-room doll house and defining a generally hemispherical upper shape. Walls having circular edges are supported upon the base and operate to divide the doll house into several "rooms". A doll having an enlarged generally hemispherical skirt is received upon the doll house with the skirt completely covering the hemispherical doll house.

U.S. Pat. No. 4,639,234 issued to Atwood sets forth a TOY PLAY SET WITH PUPPET FOR TOY ACTION FIGURES having a simulated cage including a door and arrangement for securing and releasing the door by a toy action figure a trap capable of ensnaring a toy action figure and a hand puppet monster guarding the cage. Also provided is a tree capable of grasping a toy action figure when positioned to guard the arrangement for releasing the door.

U.S. Pat. No. 5,261,849 issued to French sets forth a PUPPET/MARIONETTE THEATER having a toy or miniature theater configured for interchangeable use in staging performances such as puppet or marionette shows. A housing includes a platform and a front opening to define a stage. The platform includes an opening which can be closed to form a solid stage for the platform and can be inverted to provide access therethrough for hand puppets.

U.S. Pat. No. 4,941,859 issued to Zaruba sets forth a TOWN PLAYSET having a plurality of building facades representing a food store, pet shop, florist, post office, bank and the like which include interior details with various moveable play features.

U.S. Pat. No. 5,085,609 issued to Haberle sets forth a PUPPET THEATRE WITH SOUND TRACK AND CUED LIGHTS having a three sided enclosure including a playback device for sounds and electrical lighting. Control signal are recorded on the sound medium of the playback device and include display controls to trigger the light displays during the performance.

U.S. Pat. No. 4,462,066 issued to Gibson et al. sets forth an ELECTRICAL LIGHT CIRCUIT FOR DOLL HOUSE AND OTHER MINIATURE DISPLAYS having a miniaturized panel together with a distribution circuit for connection of various miniature accessories to a power source.

U.S. Pat. No. 4,938,730 issued to Yamane et al. sets forth a TOY HOUSE WITH MAGNETICALLY ACTUATED LIGHT having a doll house which includes a magnetically actuated switch controlling one or more light features in the toy house. One or more play pieces utilized within the house includes a magnet disposed therein which triggers the magnetic switch when the play piece is positioned near the switch.

U.S. Pat. No. 5,344,143 issued to Yule entitled MARBLE RUN GAME and U.S. Pat. No. 4,795,394 issued to Thompson entitled MARBLE TOY each set forth so-called run games which provide a pathway for a gravity powered rolling object such as a marble or the like.

U.S. Pat. No. 5,129,655 issued to Gillespie et al. sets forth a TOKEN MOVING GAME WITH SPINNING DISRUPTER having a raised playscape which resembles a three dimensional relief and which defines a pathway from the highest portion to the lowest portion. The upper portion supports a volcano situation within which a spinning object is housed to provide a game event.

While the foregoing described prior art devices have improved the art and in some instances enjoyed commercial success, there remains nonetheless a continuing need in the art for evermore interesting, attractive and amusing toy playsets.

SUMMARY OF THE INVENTION

Accordingly, it is a object of the present invention to provide an improved toy playset. It is a more particular object of the present invention to provide an improved toy playset resembling a fanciful depiction of an ant hill.

In accordance with the present invention there is provided a toy playset comprising: a base having an outer portion and a pair of end portions; a trunk secured to the base and rising vertically therefrom; an outer tent having a supporting frame joined to the trunk and the ends and a flexible fabric cover supported by the frame to form an open-front tent-like enclosure, the fabric having an inner surface and an outer surface and being formed of a light transmissive material; a plurality of generally opaque silhouettes formed on the inner surface of the fabric cover; and a light source supported within the tent-like enclosure producing a light pattern on the outer surface having a general illumination of the outer tent and dark images of the silhouettes, the outer tent glowing when the light source is active and the silhouettes give the appearance of shadows of figures within the outer tent.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figures 1, 2, 3:
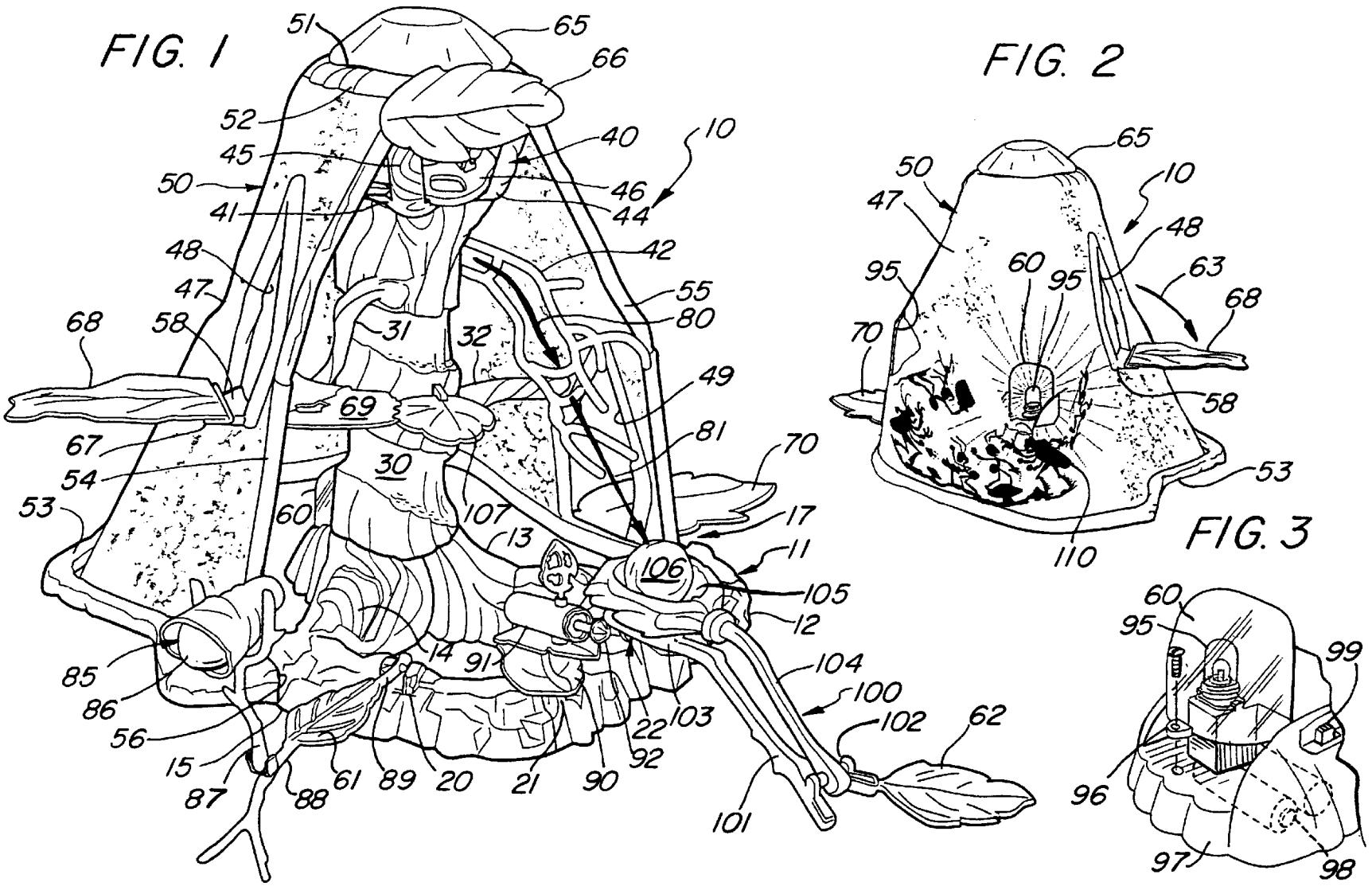
FIG. 1 sets forth a perspective front view of the present invention toy playset.
FIG. 2 sets forth a perspective rear view of the present invention toy playset.
FIG. 3 sets forth a partial view of the lighting feature of the present invention toy playset.

FIG. 1 sets forth a perspective view of a toy playset constructed in accordance with the present invention and generally referenced by numeral 10. In accordance with the selected theme of playset 10 a fanciful depiction of an anthill having a plurality of play features incorporated therein is provided. These features include a lighting feature, a plurality of projectile launchers and simulated weapons, a simulated telescope, and a ball rolling path game.

More specifically, playset 10 includes a supporting a base 11 having a pair of outwardly extending spokes 13 and 14 joined to an outer ring portion 12. Base 11 further supports a vertically extending trunk 30 having an upper platform 41 formed thereon. Outer ring 12 further supports an end 15 having a coupler 16 (seen in FIG. 4) and a telescope mount 20. Outer ring 12 further includes a weapon mount 21 and a catapult mount 22. A connector 17 is formed at the outer edge of ring 12. A light housing 60 is supported upon the rear side of trunk 30 and is operable in the manner shown in FIG. 2.

Trunk 30 further supports a top cage 40 joined to platform 41 and having a plurality of upwardly extending posts such as posts 44 and 45. Within cage 40 a moveable table 46 is supported.

An outer tent generally referenced by numeral 50 includes an upper frame 52 having a center aperture 51 formed therein and a pair of downwardly extending a generally diverging door frame pieces 54 and 55. Door frame pieces 54 and 55 are secured to a generally U-shaped base frame 53. Outer tent 50 further includes a fabric cover 47 supported upon base frame 53, door frames 54 and 55 and upper frame 52 to simulate the outer surface of a fanciful anthill. The fabric selected for fabric cover 47 is preferably translucent in character to accommodate the silhouette feature shown in FIG. 2. Outer tent 50 further includes a window opening 48 supporting a sill 58. A window 49 is supported on the opposite side of outer tent 50 and includes a sill 59.

In accordance with the present invention, playset 10 further includes a ball rolling path 42 which extends downwardly about trunk 30 and is fashioned to generally replicate a plurality of twisted branches or roots in accordance with the present invention playset theme.

A lid 65 received upon center aperture 41 of upper frame 52 is supported by cage 40. A cover 66 is positioned upon upper frame 52 and secured thereto by conventional attachment means (not shown)

Trunk 30 further supports a trap door 69 secured to support 31 and a platform 107 secured to trunk 30. A platform 68 is secured by a hinge 67 to sill 58 of window 48 and is generally aligned with trap door 69. The interior edge of trap door 69 rests upon platform 107.

A platform 70 is secured to sill 59 of window 49 in an attachment similar to that of platform 68 using hinge 67.

A simulated telescope 85 includes an outer lens 86 and a vertical support 87. A telescope base 88 includes an end 89 received within telescope mount 20 and secures support 87.

A projectile launcher 91 having a launchable projectile 92 received therein is supported upon a base 90 which in turn is received within and secured to weapon mount 21 of outer ring 12. Projectile launcher 91 and projectile 92 are shown in greater detail in FIG. 9. Suffice it to note here that launcher 91 and projectile 92 are constructed in accordance with conventional fabrication techniques.

Playset 10 further includes a catapult 100 having a base 101 secured to catapult mount 22 at an interior end 103. Catapult 100 includes a pivoting coupler 102 which includes a coiled spring (not shown). Coupler 102 and its internal spring cooperate to urge beam 104 of catapult 100 upwardly. Beam 104 supports a projectile basket 105 which receives a descending ball 106.

Playset 10 as a result provides a plurality of play features able to accommodate a plurality of toy figures a various positions such as platform 51, platform 68, trap door 69, platform 107, base 90, platform 62 and platform 70.

FIG. 2 sets forth a rear perspective view of playset 10 utilizing the light feature of the inventive structure. As described above, playset 10 includes an outer tent 50 having a supporting base 53 and a fabric cover 47. Fabric cover 47 further supports a window 48 having a platform 68 pivotally supported upon sill 58 thereof. Platform 68 may be raised to cover window 48 or lowered in the direction indicated by arrow 63 to the extending position shown in FIG. 2. A platform 70 extends outwardly from a window 49 (seen in FIG. 1). In accordance with an important aspect of the present invention a light housing 60 supporting a light bulb 95 is secured to the rear portion of trunk 30 (seen in FIG. 1). In further accordance with the present invention interior surface 95 of fabric cover 47 supports a plurality of generally opaque silhouettes 110. Silhouettes 110 are painted upon or printed upon or otherwise disposed upon interior surface 95 of fabric cover 47 to provide darken silhouettes which contrast substantially from the remainder of fabric cover 47 when bulb 95 of light housing 60 is energized. Thus as light glows outwardly from translucent fabric cover 47 silhouettes 100 are dramatically visible and provide the impression that the interior of tent 50 is filled with various creatures.

FIG. 3 sets forth a partial perspective view of light housing 60 supporting bulb 95. Light housing 60 is received upon a supporting base 97 which is secured to the rear surface of trunk 30 (seen in FIG. 1). Base 97 supports an internal battery power source 98 which is operatively coupled to bulb 95 through a switch 99 using conventional couplers and wiring (not shown). To facilitate replacement of bulb 95 light housing 60 is secured to base 97 by a conventional fastener passing through an aperture formed in flange 96 of housing 60.

Figure 4:
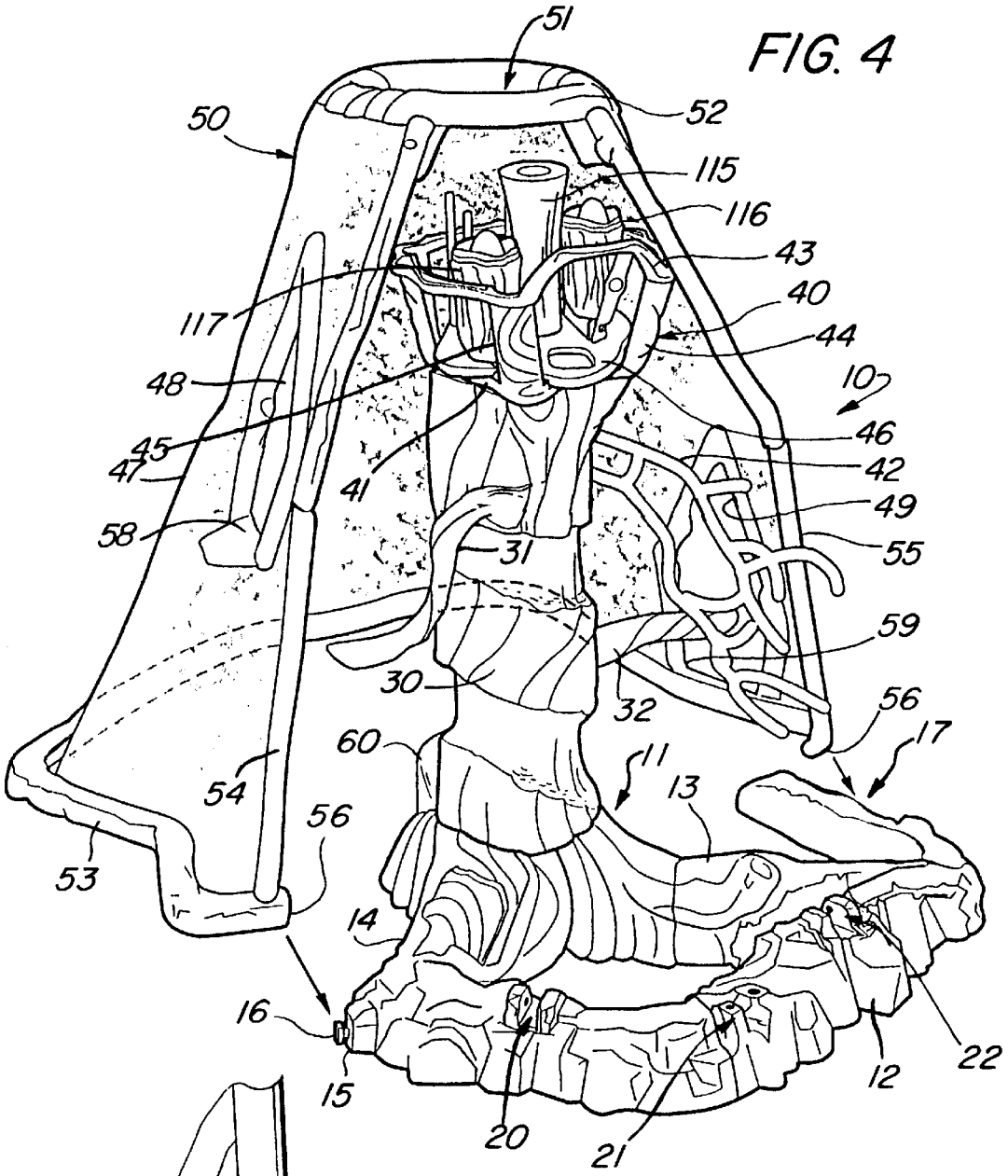
FIG. 4 sets forth a perspective assembly view showing the outer anthill covering of the present invention being assembled to the base structure.

FIG. 4 sets forth a perspective assembly view showing the attachment of outer tent 50 to trunk 30 and base 11 of playset 10.

More specifically, playset 10 includes a supporting a base 11 having a pair of outwardly extending spokes 13 and 14 joined to an outer ring portion 12. Base 11 further supports a vertically extending trunk 30 having an upper platform 41 formed thereon. Outer ring 12 further supports an end 15 having a coupler 16 (seen in FIG. 4) and a telescope mount 20. Outer ring 12 further includes a weapon mount 21 and a catapult mount 22. A connector 17 is formed at the outer edge of ring 12. A light housing 60 is supported upon the rear side of trunk 30 and is operable in the manner shown in FIG. 2.

Trunk 30 further supports a top cage 40 joined to platform 41 and having a plurality of upwardly extending posts such as posts 44 and 45. Within cage 40 a moveable table 46 is supported.

An outer tent generally referenced by numeral 50 includes an upper frame 52 having a center aperture 51 formed therein and a pair of downwardly extending a generally diverging door frame pieces 54 and 55. Door frame pieces 54 and 55 are secured to a generally U-shaped base frame 53. Outer tent 50 further includes a fabric cover 47 supported upon base frame 53, door frames 54 and 55 and upper frame 52 to simulate the outer surface of a fanciful anthill. The fabric selected for fabric cover 47 is preferably translucent in character to accommodate the silhouette feature shown in FIG. 2. Outer tent 50 further includes a window opening 48 supporting a sill 58. A window 49 is supported on the opposite side of outer tent 50 and includes a sill 59.

In accordance with the present invention, playset 10 further includes a ball rolling path 42 which extends downwardly about trunk 30 and is fashioned to generally replicate a plurality of twisted branches or roots in accordance with the present invention playset theme.

Top cage 40 includes a rail 43 supported by the posts of top cage 40 such as post 44 and 45. In addition, moveable table 46 supports a pair of projectile launchers 116 and 117 together with an upwardly extending stem 115. Stem 115 provides support for lid 65 (seen in FIG. 1). Projectile launchers 116 and 117 are shown in their withdrawn positions corresponding to the lowered position of movable table 46.

Figure 5:
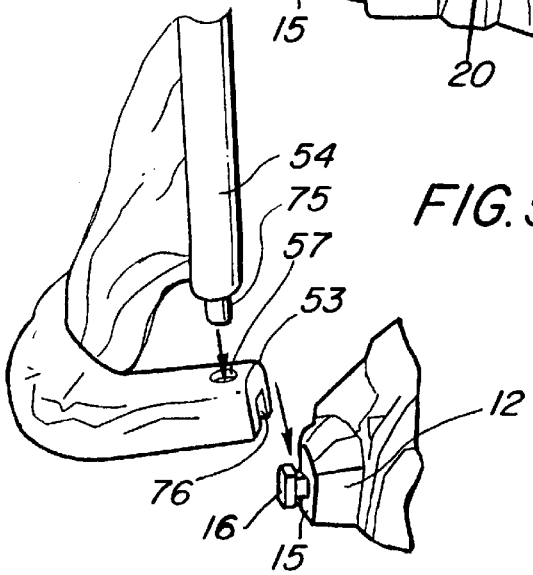
FIG. 5 sets forth a partial perspective view of the outer covering attachment to the base of the present invention toy playset.

FIG. 5 sets forth a perspective assembly view of the attachment of door frame 54 to base frame 53 and the further attachment to end 15 of outer ring 12. Thus base frame 53 defines an aperture 57 while door frame 54 defines a post 75 inserted therein. Door frame 53 further includes a slot 76 received upon a coupler 16 of outer ring 12. The attachment seen in FIG. 5 are typical of the snap-fit attachments preferably utilized in assembling in the various components of the present invention toy playset.

Figures 6, 7, 8, 9:
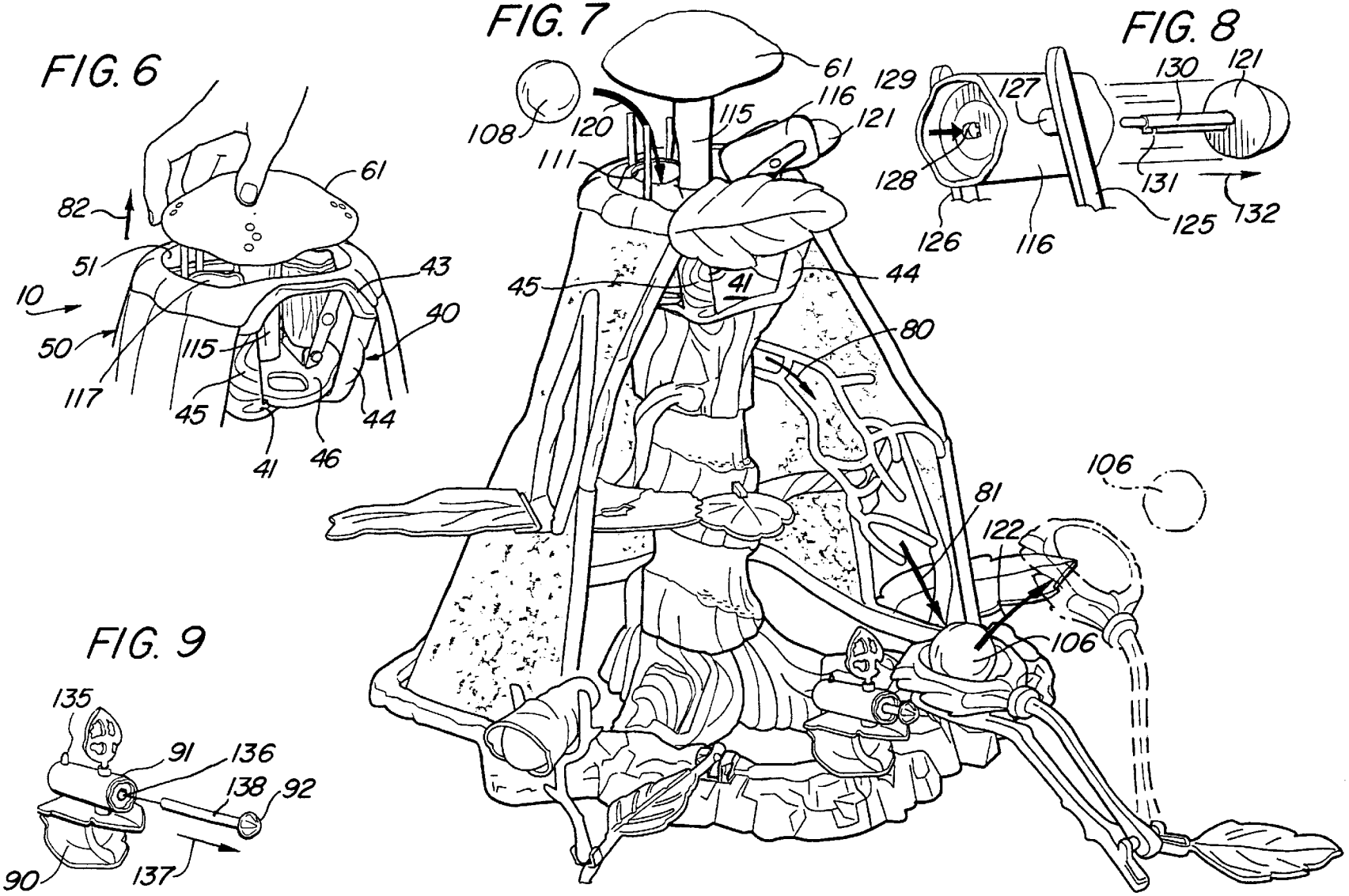
FIG. 6 sets forth a partial perspective view of the upper platform raising of the present invention toy playset.
FIG. 7 sets forth a perspective view of the present invention toy playset having the upper platform in a raised position.
FIG. 8 sets forth a partial perspective view of a projectile launcher supported on the upper platform of the present invention toy playset.
FIG. 9 sets forth a perspective view of an additional projectile launcher utilized on the present invention toy playset.

FIG. 6 sets forth a partial perspective view of the upper portion of playset 10 illustrating the opening of the toy portion thereof. Playset 10 includes an outer tent 50 having a fabric cover 47 supported to form an aperture 51 at the upper portion thereof. A top cage 40 having a platform 41 supporting posts such as posts 44 and 45 and an upper rail 43 are supported upon trunk 30 in the manner shown in FIG. 4. A table 46 is supported upon platform 41 and includes a center stem 115 and pair of projectile launchers 116 and 117. Projectile launchers 116 and 117 are shown in their withdrawn position necessary to receive table 46 and projectile launchers 116 and 117 within aperture 51. Stem 115 is secured to lid 61 and provides a rigid coupling between lid 61 and table 46.

In operation with lid 61 initially positioned in the closed position shown in FIG. 1, the user raises lid 61 in the direction indicated by arrow 82 drawing the combined structure of lid 61, stem 115, table 46 and projectile launchers 116 and 117 upwardly to the raised position shown in FIG. 7. The return of lid 61 to its closed position is achieved by simply pressing downwardly upon lid 61 returning the combined assembly to the position shown in FIG. 1.

FIG. 7 sets forth a perspective frontal view of toy playset 10 illustrating the ball rolling path and catapult feature of the present invention structure. It will be apparent by comparison by FIGS. 7 and 1 that FIG. 7 shows lid in its raised position which facilitates operation of several features of the present invention toy playset. Conversely the closed position shown in FIG. 1 covers these operative features.

More specifically, playset 10 includes a supporting a base 11 having a pair of outwardly extending spokes 13 and 14 joined to an outer ring portion 12. Base 11 further supports a vertically extending trunk 30 having an upper platform 41 formed thereon. Outer ring 12 further supports an end 15 having a coupler 16 (seen in FIG. 4) and a telescope mount 20. Outer ring 12 further includes a weapon mount 21 and a catapult mount 22. A connector 17 is formed at the outer edge of ring 12. A light housing 60 is supported upon the rear side of trunk 30 and is operable in the manner shown in FIG. 2.

Trunk 30 further supports a top cage 40 joined to platform 41 and having a plurality of upwardly extending posts such as posts 44 and 45. Within cage 40 a moveable table 46 is supported.

An outer tent generally referenced by numeral 50 includes an upper frame 52 having a center aperture 51 formed therein and a pair of downwardly extending a generally diverging door frame pieces 54 and 55. Door frame pieces 54 and 55 are secured to a generally U-shaped base frame 53. Outer tent 50 further includes a fabric cover 47 supported upon base frame 53, door frames 54 and 55 and upper frame 52 to simulate the outer surface of a fanciful anthill. The fabric selected for fabric cover 47 is preferably translucent in character to accommodate the silhouette feature shown in FIG. 2. Outer tent 50 further includes a window opening 48 supporting a sill 58. A window 49 is supported on the opposite side of outer tent 50 and includes a sill 59.

In accordance with the present invention, playset 10 further includes a ball rolling path 42 which extends downwardly about trunk 30 and is fashioned to generally replicate a plurality of twisted branches or roots in accordance with the present invention playset theme.

A lid 65 received upon center aperture 41 of upper frame 52 is supported by cage 40. A cover 66 is positioned upon upper frame 52 and secured thereto by conventional attachment means (not shown).

Trunk 30 further supports a trap door 69 secured to support 31 and a platform 107 secured to trunk 30. A platform 68 is secured by a hinge 67 to sill 58 of window 48 and is generally aligned with trap door 69. The interior edge of trap door 69 rests upon platform 107.

A platform 70 is secured to sill 59 of window 49 in an attachment similar to that of platform 68 using hinge 67.

A simulated telescope 85 includes an outer lens 86 and a vertical support 87. A telescope base 88 includes an end 89 received within telescope mount 20 and secures support 87.

A projectile launcher 91 having a launchable projectile 92 received therein is supported upon a base 90 which in turn is received within and secured to weapon mount 21 of outer ring 12. Projectile launcher 91 and projectile 92 are shown in greater detail in FIG. 9. Suffice it to note here that launcher 91 and projectile 92 are constructed in accordance with conventional fabrication techniques.

Playset 10 further includes a catapult 100 having a base 101 secured to catapult mount 22 at an interior end 103. Catapult 100 includes a pivoting coupler 102 which includes a coiled spring (not shown). Coupler 102 and its internal spring cooperate to urge beam 104 of catapult 100 upwardly. Beam 104 supports a projectile basket 105 which receives a descending ball 106.

Lid 61 is supported upon table 46 (seen in FIG. 6) by a ridged stem 115. In the raised position shown the projectile launchers supported upon table 46 are pivoted to their launching positions. For example, projectile launcher 116 supporting projectile 121 in the manner set forth in FIG. 8 is extended to a generally upwardly angled horizontal launch position. In addition, an aperture 11 is formed upon table 46 which is sized to received a circular projectile or ball 108 in the manner indicated by arrow 120. The upper end of ball rolling path 42 extends beneath aperture 111 to receive ball 108 as it drops through aperture 111. Thereafter, the pathway formed by rolling ball path 42 guides ball 108 downwardly in the direction indicated by arrow 80 and allows it to drop from the lower end of ball rolling path 42 into basket 105 of catapult 100 in the position shown by ball 106. The impact of the descending ball upon basket 105 releases the spring latch of catapult 100 allowing beam 104 to pivot upwardly toward the dash-line position shown which in turn launches ball 106 in the direction indicated by arrow 122. Thus in accordance with an important aspect of the present invention, the user is able to cock catapult 100 by pivoting beam 104 downwardly and thereafter depositing a ball through aperture 11 which descends to basket 105 of catapult 100 and which thereafter is launched as catapult 100 is triggered.

FIG. 8 sets forth a rear perspective view of launcher 116 and projectile 121. Launcher 116 is pivotally supported by a pair of side support 125 and 126 having lower ends secured to table 46 (seen in FIG. 6). A pivotal attachment 127 secures projectile 116 to support 125 and a similar pivotal attachment (not shown) secures projectile launcher 116 to support 126. The base of projectile launcher 116 supports a trigger tab 128.

Projectile 121 includes an elongated stem 130 having a notch 131 formed therein. In accordance with conventional fabrication techniques stem 130 of projectile 121 is forced into projectile launcher 116 causing a conventional trigger latch mechanism (not shown) within projectile launcher 116 to engage notch 131 against an internal power spring (also not shown). Thereafter, the user simply presses trigger button 128 releasing notch 131 and allowing projectile 121 to be launched in the direction indicated by arrow 132.

FIG. 9 sets forth a perspective view of projectile launcher 91 together with projectile 92. As described above, projectile launcher 91 is supported upon a base 90 which in turn is secured to outer ring 12 of toy 10 (seen in FIG. 1). Projectile launcher 91 is fabricated in accordance with conventional fabrication techniques and thus includes a conventional spring driven launcher having a trigger 135 and a passage 136. In further accordance with conventional fabrication techniques, projectile 92 includes a stem 138 received within passage 136. Projectile 92 is loaded into projectile launcher 91 by forcing a portion of stem 138 through passage 136 cocking the conventional spring driven launcher mechanism within launcher 91 (not shown). Once trigger 135 is actuated projectile 92 is launched outwardly in the direction indicated by arrow 97. Launcher 91 and projectile 92 may each be fabricated entirely in accordance with conventional fabrication techniques.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy playset comprising:

a base having a central portion, an outer portion and a pair of end portions extending from the central portion to the outer portion;

a trunk secured to the base and rising vertically therefrom;

an outer tent having a supporting frame supported by said trunk and said end portions, said outer tent further including a flexible fabric cover supported by said frame to form a tent-like enclosure, said flexible fabric cover constructed to have an open front portion, said flexible fabric cover further defined by an inner surface and an outer surface and being formed of a light transmissive material;

a plurality of generally opaque silhouettes formed on said inner surface of said fabric cover; and a light source supported within said tent-like enclosure configured to produce a light pattern on said outer surface having a general illumination of said outer tent and dark images of said silhouettes, said outer tent glowing when said light source is active and said silhouettes give the appearance of shadows of figures within said outer tent.

2. The toy playset set forth in claim 1 wherein said base and said trunk have shapes resembling tree branches and a tree trunk respectively.

3. The toy playset set forth in claim 2 wherein said outer tent defines a generally conical shape having a rear portion and an open frontal portion.

4. The toy playset set forth in claim 3 wherein said silhouettes depict shapes suggestive of fanciful insects.

5. The toy playset set forth in claim 4 further including a catapult having projectile basket for receiving a projectile and a ball guide supported by said trunk for receiving a ball-like projectile and directing it into said projectile basket.

6. The toy playset set forth in claim 5 wherein said outer tent defines an upper aperture and wherein said toy playset further includes a lid supported by said trunk and movable between a raised position opening said aperture and a closed position covering said aperture.

* * * * *